US006015957A

United States Patent [19]

Papallo, Jr. et al.

[11] Patent Number: 6,015,957

[45] Date of Patent: Jan. 18, 2000

[54] HIGH AMPACITY PINLESS CONDUCTING JOINT IN MOVABLE CONTACT ARM ASSEMBLY

[75] Inventors: Thomas F. Papallo, Jr., Farmington; Raymond K. Seymour; Anupam Tiwari, both of Plainville, all of Conn.

[73] Assignee: General Electric Company, Schenectady, N.Y.

[21] Appl. No.: 09/223,743

[22] Filed: Dec. 31, 1998

[51] Int. Cl.[7] ..... H01H 9/30

[52] U.S. Cl. ..... 200/244; 218/32; 218/146; 335/16

[58] Field of Search ..... 200/6 R, 17 R, 200/4, 564, 239, 244, 245, 248, 271, 273–274, 50, 32, 401; 218/22, 30–33, 146; 335/16, 192, 195

[56] References Cited

U.S. PATENT DOCUMENTS

| | | | |
|---|---|---|---|
| 2,606,983 | 8/1952 | Rypinski | 200/166 |
| 3,264,442 | 8/1966 | Holzer | 200/166 |
| 3,286,067 | 11/1966 | Menickella et al. | 200/153 |
| 4,864,261 | 9/1989 | Kandatsu | 335/16 |
| 5,032,813 | 7/1991 | Gula et al. | 335/195 |

*Primary Examiner*—Michael Friedhofer

*Attorney, Agent, or Firm*—Cantor Colburn LLP; Carl B. Horton

[57] ABSTRACT

An air circuit breaker movable contact arm assembly is presented. The movable contact arm assembly comprises an electrically-conductive support having at least one slot formed therein to receive a first end of the movable contact arm. The movable contact arm comprises first and second sides which face side walls of the electrically-conductive support within the slot. A spring washer is disposed at the first end of the movable contact arm and loads the second side of the movable contact arm against one side wall of the electrically-conductive support to form a variably conducting joint therebetween. By using a spring washer, the movable contact arm pivotally engages the other facing side wall of the electrically-conductive support to provide a variable pivot point. The variable pivot point of the contact arm assembly permits an additional degree of freedom allowing the movable contact arm to rotate about a separate, variable pivot point.

10 Claims, 2 Drawing Sheets

HIGH AMPACITY PINLESS CONDUCTING JOINT IN MOVABLE CONTACT ARM ASSEMBLY

BACKGROUND OF THE INVENTION

This invention relates generally to circuit breakers and more specifically relates to a pinless conducting joint and variable pivot point in a movable contact arm assembly which permits the contact arm to have a greater degree of freedom in response to high current events.

Electrical distribution devices are well known in the art. A conventional circuit breaker includes a pair of contacts which allows circuit current to pass from one contact member to the other contact member. A typical circuit breaker uses a movable contact structure in which one contact is disposed at a stationary location, such as a stationary contact arm, while the other contact is disposed on a movable contact arm. The movable contact arm generally comprises a pivoted contact arm for making and breaking the circuit at a single location. The movable contact arm is usually connected to a conducting support at one end of the contact arm, wherein the opposite end includes the contact. The connection between the contact arm and the conducting support is made by using a contact arm pivot pin in which the contact arm pivot pin extends through an aperture in the contact arm and in the conducting support.

The use of the pivot pin permits rotation of the contact arm about the pivot pin so that the contact arm rotates about the pivot pin to separate the contacts. One limitation of using a pivot pin for a conducting joint formed by the connection between the conducting support and the contact arm is that the contact arm can only rotate in an opening direction. In response to magnetic forces of high current, non-trip condition, the contact of the breaker will rotate a small angle in the open direction, failing to maintain contact.

Typically, the circuit breaker and more specifically, the contact arm assembly thereof, includes a second pin or moving stop which interacts with the movable contact arm assembly to insure that all of the movable contact arms operate in unison when the operating mechanism is articulated. Thus, when the second pin or moving stop is moved in response to the actuation of the operating mechanism, current is prevented from flowing through each of the contact arm assemblies and the load is protected.

BRIEF SUMMARY OF THE INVENTION

In an exemplary embodiment of the present invention, a movable contact arm assembly comprises an electrically-conductive support having at least one slot formed therein for receiving a first end of a movable contact arm which is disposed within the slot. At an opposite end, the movable contact arm has a movable contact attached thereto. The movable contact arm comprises first and second sides which face opposing side walls of the electrically-conductive support. A spring washer is disposed at the first end of the movable contact arm and loads the second side of the movable contact arm against one of the side walls of the electrically-conductive support to form a conducting joint therebetween. The spring washer pivotally engages the other opposing side wall of the electrically-conductive support to provide a variable pivot point. Advantageously, the variable pivot point of the movable contact arm assembly permits an additional degree of freedom allowing the movable contact arm to rotate about a separate pivot point. The movable contact arm can rotate a small angle about this separate pivot in response to the magnet forces resulting from a high current event, maintaining good electrical contact of the contact pair.

BRIEF DESCRIPTION OF THE DRAWINGS

Referring now to the drawings wherein like elements are numbered alike in the several figures.

DETAILED DESCRIPTION OF THE INVENTION

Figure 1:
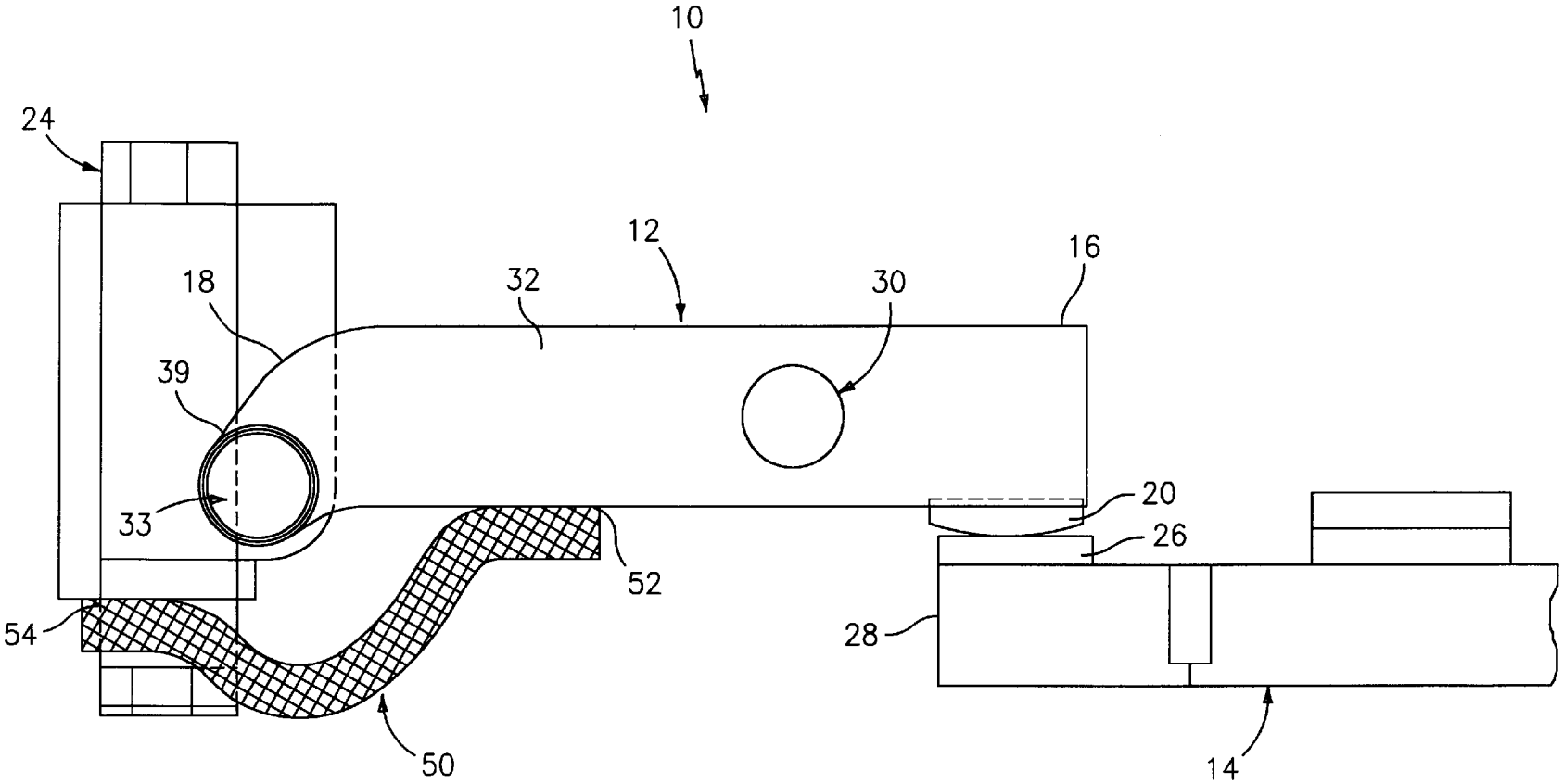
FIG. 1 is a cross-sectional side view of the contact arm assembly of the present invention.
Figure 2:
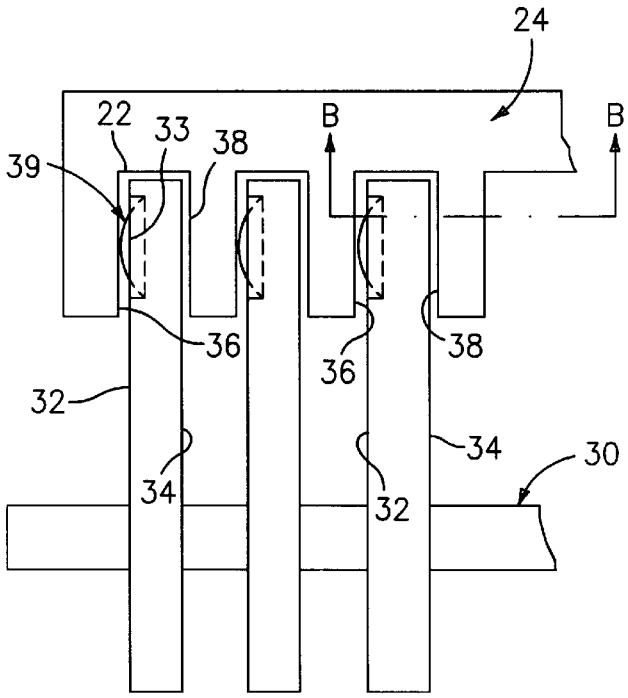
FIG. 2 is a partially fragmented top plan view of an exemplary assembly of a plurality of contact arms.

FIG. 1 is a cross-sectional side view of an exemplary contact arm assembly 10 suitable for use in an air circuit breaker which consists of a case to which a cover is attached (not shown). For the purpose of illustration only, FIG. 1 shows only a single contact arm assembly 10, while it is within the scope of the present invention that a plurality of contact arm assemblies 10 are incorporated into the circuit breaker, as shown in FIG. 2. Contact arm assembly 10 comprises an upper contact arm 12 and a lower contact arm 14, wherein upper contact arm 12 is rotatable and typically is referred to as a movable contact arm. Lower contact arm 14 is usually a stationary contact arm; however, it is within the scope of the present invention that lower contact arm 14 may have some degree of movement during a high current event. Upper contact arm 12 includes a first end 16 and an opposite second end 18, wherein a movable contact 20 is disposed at first end 16 and forms a part of a main contact pair. Second end 18 of upper contact arm 12 is disposed within a slot 22 (shown in FIG. 2) formed in a fixed conductor 24, wherein upper contact arm 12 is coupled thereto as will be described in greater detail hereinafter. Lower contact arm 14 includes a fixed contact 26 disposed at a first end 28 thereof, wherein fixed contact 26 and movable contact 20 form the main contact pair.

A contact arm pivot pin 30 interacts with the movable contact arm assembly 10 to insure that the movable upper contact arm 12 moves upward away from lower contact arm 14 during a trip event to separate contacts 20 and 26. Because, the air circuit breaker typically includes a plurality of contact arm assemblies 10 contact arm pivot pin 30 is intended to interact with all of the contact arm assemblies 10 within the circuit breaker to insure that all of the upper contact arms 12 operate in unison when an operating mechanism is articulated. As is known in the art, an actuator unit interfaces with the operating mechanism to separate the circuit breaker fixed and movable contacts 26 and 20 during a trip event. Each upper contact arm 12 has an aperture extending through upper contact arm 12, wherein the aperture is located between first end 16 and second end 18. The aperture is sized to receive contact arm pivot pin 30 so that actuation of the operating mechanism causes the movement of contact arm pivot pin 30 resulting in a disruption of current flow through contacts 20 and 26. In being understood that when the circuit breaker includes a plurality of contact arm assemblies 10, the apertures within each upper contact arm 12 are axially aligned to permit the contact arm pivot pin 30 to extend therethrough across the plurality of contact arm assemblies 10.

Figure 3:
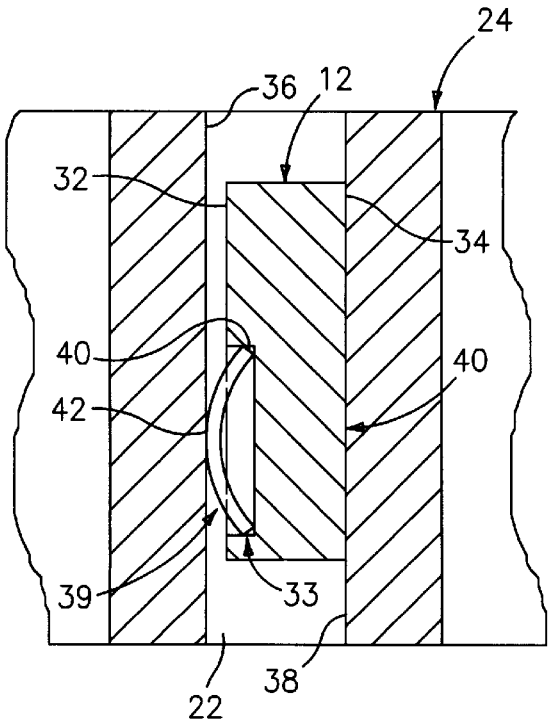
FIG. 3 is an enlarged cross-sectional view of a part of the contact arm assembly of FIG. 2 taken along the line 3—3.

Referring now to FIGS. 2 and 3, which illustrates the pinless conducting joint of the present invention, generally designated as 40. Upper contact arm 12 comprises a first side 32 and an opposite second side 34, the first side 32 facing a third side wall 36 and facing a fourth side wall 38, wherein third and fourth side walls 36 and 38 form, in part, slot 22 of fixed conductor 24. As is known in the art, a conducting joint 40 is created between upper contact arm 12 and fixed conductor 24 to permit current to flow the length of upper contact arm 12 to contact 26 and subsequently to lower contact arm 14 via closed contacts 26 and 20.

Formed in first side 32 at first end 16 of upper contact arm 12 is a counter bore 33. Counter bore 33 is sized to receive a circular spring washer 39 and retains circular spring washer 39 within upper contact arm 12. Conducting joint 40 is created by the biasing action of circular spring washer 39 which loads second side 34 of upper contact arm 12 against fourth side wall 38 of fixed conductor 24. Circular spring washer 39 includes cut edges 40 which are disposed within counter bore 33 where no relative motion exists between upper contact arm 12 and circular spring washer 39. Cut edges 40 serve to locate and secure circular spring washer 34 against counter bore 33 by providing friction edges which engage counter bore 33. Circular spring washer 39 also includes a smooth surface 42 which contacts and rides against third side wall 36 of fixed conductor 24 to provide improved degree of freedom for upper contact arm 12. More specifically, the point of contact between upper contact arm 12 and third side wall 36 of fixed conductor 24 is limited to an area on smooth surface 42. This limited area of contact permits upper contact arm 12 to easily move along third side wall 36, in part because of the nature of its smooth surface.

Thus, upper contact arm 12 is adapted to pivot (rotate) and slide within slot 22 in response to an increase of current flowing through the circuit breaker, while at the same time it maintains a good electrical connection with fixed conductor 24. As smooth surface 42 rides against third side wall 36 of fixed conductor 24, a separate pivot point between upper contact arm 12 and fixed conductor 24 within slot 22 is formed for contact arm assembly 10 and permits upper contact arm 12 to rotate closed during high current events.

Thus when high current conditions occur, it is important that the movable upper contact arm 12 maintain good electrical contact with its support, namely fixed conductor 24, while movable contact 20 remains in intimate contact with fixed contact 26. The present invention provides the desired electrical contact between upper contact arm 12 and its support (fixed conductor 24) by employing pinless conducting joint 40 which is adapted to move as a result of the riding action of circular spring washer 39. In a conventional pivot pin connection between the movable contact arm and its support, the movable contact arm is exposed to mechanical force by movement of the movable contact arm during high or overcurrent events. In this conventional assembly, the degree of freedom for the contact arm to move is limited by the design of the pivot pin and the degree of rotation which is permitted by assembly. Contact arm assembly 10 of the present invention eliminates this problem by employing a contact arm assembly which is free to ride along fixed conductor 24 under high current conditions. The permissible degree of rotation for contact arm 12 is significantly improved by the present invention.

Referring to FIG. 1, contact arm assembly 10 further includes a contact braid 50 welded, brazed, or mechanically fixed to upper contact arm 12 at a location 52 which generally comprises a point on a bottom surface 54 of upper contact arm 12 between counter bore 33 and contact arm pivot pin 30. An opposite end of contact braid 50 is connected to fixed conductor 24 at a weld 54. Under all conduction conditions, both nominal rated current and high current events, conducting joint 40 carries the majority of the current. Because of this, the cross sectional area of contact braid 50 is sized to meet only the commutation requirements. This result in a braid cross section that is substantially smaller than is typically found in 2,000 Amp or higher continuous current air circuit breakers. Contact braid 50 is used to maintain joint conductivity during high current events. Under high current events, current freely flows through fixed conductor 24 to contact braid 50 which permits the current to flow therethrough to upper contact arm 12. Because the contact arm assembly 10 of the present invention is a pinless assembly, the forces resulting from the high current event do not press upper contact arm 12 against a pin, and consequently the pin against fixed conductor 24, and good electrical contact is not maintained. Contact braid 50 overcomes this deficiency and maintains good electrical contact of the pinless joint during high current events.

Furthermore because of the sliding action of upper contact arm 12 during high current events, contact braid 50 provides current commutation at the high currents while conducting joint 40 is sliding. Conducting joint 40 freely slides against fourth side wall 38 under high currents as a result of employing a pinless conducting joint 40 in contact arm assembly 10. This results because when conducting joint 40 slides, new contact points along conducting second side 34 and conducting fourth side wall 38 are established. The high currents must rapidly commutate from the previous contact points to the newly established contact points. At high current levels, the time required for the current to commutate to the new contact points will be less than the rate at which the new contact points are established because of the high velocity of the contact arm in motion. Thus by providing contact braid 50, current is commutated to upper contact arm 12 during high current events and freely flows to lower contact arm 14 for normal operation of the circuit breaker.

Pinless conducting joint 40 adds an additional degree of freedom allowing upper contact arm 12 to rotate about a separate pivot point which is formed by the interaction between smooth surface 42 of circular spring washer 39 and third side 36 of fixed conductor 24. Upper contact arm 12 of the present invention can rotate a small angle about this separate pivot point in response to the magnet forces resulting from a high current event. This enables the magnetic forces to add to the closing force of upper contact arm 12 and contacts 20 and 26 remain closed during a high current event, until the circuit breaker mechanism is released. Consequently, during high current, non-trip conditions, current flows across contact arms 12 and 14 without any disruption in current flow due to the small angle of movement of upper contact arm 12 about the separate pivot pin.

By providing a pinless conducting joint 40, which typically comprises a second pivot pin pivotally attaching upper contact arm 12 to fixed conductor 24, the need for the second pivot pin joint is eliminated. Moreover, the additional heat generated by the additional joint is eliminated. Because contact arm assembly 10 of the present invention does not require a large cross section of flexible conductors or multiple joints, e.g., braids or laminations, the associated cost and manufacturing difficulty is eliminated. Consequently, contact arm assembly 10 of the present invention offers a much more simpler and cost effective assembly in addition to the improved degree of freedom which allows upper contact arm 12 to rotate about a separate pivot point during varying current conditions, e.g., high-current conditions.

While preferred embodiments have been shown and described, various modifications and substitutions may be made thereto without departing from the spirit and scope of the present invention. Accordingly, it is to be understood that the present invention has been described by way of illustrations and not limitation.

What is claimed is:

1. A movable contact arm assembly for air circuit breakers comprising:

an electrically-conductive support having at least one slot formed therein, the at least one slot being defined in part by first and second walls;

a movable contact arm having first and second sides, a first end and an opposite second end, the first end being received within the at least one slot, and wherein the movable contact arm includes a movable contact attached to the second end;

a spring washer disposed on the first side of the movable contact arm proximate the first end thereof so that the spring washer loads the second side of the movable contact arm against the second wall of the electrically-conductive support to form a conducting joint; and wherein the spring washer pivotally engages the first wall of the electrically-conductive support to provide a variable pivot point.

2. The movable contact arm assembly of claim 1, further including:

a counter bore formed in the first side at the first end of the movable contact arm.

3. The movable contact arm assembly of claim 2, wherein the spring washer is disposed within the counter bore at the first end.

4. The movable contact arm assembly of claim 2, further including:

an elongated pivot pin extending through an aperture formed in the movable contact arm, the aperture being located between the movable contact and the counter bore, the pivot pin providing a second axis for the movable contact arm to rotate about during high current or over current conditions.

5. The movable contact arm assembly of claim 2, wherein the spring washer includes cut edges and a smooth surface opposite the cut edges.

6. The movable contact arm assembly of claim 5, wherein the spring washer comprises:

a generally hemispherical spring member with the smooth surface comprises an outer hemispherical surface.

7. The movable contact arm assembly of claim 5, wherein the cut edges of the spring washer contact an inner surface of the counter bore when the spring washer is disposed therein.

8. The movable contact arm assembly of claim 5, wherein the variable pivot point is formed by a portion of the smooth surface of the spring washer which contacts the first wall of the electrically-conductive support.

9. The movable contact arm assembly of claim 5, further including a second pivot point having a distinct axis of rotation being formed when the movable contact arm moves along the first wall of the electrically-conductive support under high current conditions.

10. The movable contact arm assembly of claim 1, further including:

a braid conductor having first and second ends, the first end being attached to the movable contact arm, the second end being attached to the electrically-conductive support.

* * * * *